United States Patent [19]

Buranathanit

[11] Patent Number: 4,822,976

[45] Date of Patent: Apr. 18, 1989

[54] AUTOMOBILE DOOR LOCK WARMER

[76] Inventor: Pinyawat Buranathanit, 1927 St. Clair Ave., Greensburg, Pa. 15601

[21] Appl. No.: 89,166

[22] Filed: Aug. 25, 1987

[51] Int. Cl.[4] ..... E05B 17/00; H05B 3/00; F24H 3/04

[52] U.S. Cl. ..... 219/202; 70/431; 219/201; 219/370; 219/373

[58] Field of Search ..... 219/200, 201, 202, 369, 219/370, 373; 70/431

[56] References Cited

U.S. PATENT DOCUMENTS

| | | | |
|---|---|---|---|
| 2,538,872 | 1/1951 | Jones | 219/201 X |
| 2,774,855 | 12/1956 | Simmons | 219/201 X |
| 3,192,359 | 7/1965 | Swindall | 219/201 |

FOREIGN PATENT DOCUMENTS

| | | | |
|---|---|---|---|
| 2637484 | 4/1928 | Fed. Rep. of Germany | 219/201 |

*Primary Examiner*—Anthony Bartis

*Attorney, Agent, or Firm*—Jerry T. Kearns

[57] ABSTRACT

An automobile door lock warming device has a housing which surrounds the door lock cylinder on a conventional automobile door lock. A heating element is contained in the housing and also an electrical fan. A switch is mounted on the exterior of the automobile. In use, the user activates the switch which turns on the heating element and the fan, thus blowing warm air through the housing and onto the door lock cylinder. In a second embodiment, the housing includes a helical rib which swirls the warmed air around the door lock cylinder and exhausts the air through a plurality of ports which are spaced circumferentially around the keyhole. A pivotable cover for the keyhole and exhaust ports is provided.

7 Claims, 1 Drawing Sheet

AUTOMOBILE DOOR LOCK WARMER

BACKGROUND OF THE INVENTION

1. Field of the Invention

The present invention relates to automobile door lock warmers, and more particularly pertains to a new and improved automobile door lock warmer in which a fan blows heated air onto the door lock cylinder. In cold climates, and particularly in cold and humid climates, freeze-up of automobile door locks is an annoying problem. This freeze-up is caused by an accumulation of moisture within the door lock, and also by the simple freezing of lubricants within the lock mechanism. The problem is particularly acute in regions affected with freezing rain. Also, in very cold climates, the hands of an automobile owner may become numb by the cold to an extent where it is impossible to manipulate the key in the lock. This, in conjunction with the aforementioned lock freeze-up problems has frustrated many a vehicle owner.

2. Description of the Prior Art

Various types of automobile door lock warmers are known in the prior art. A typical example of such an automobile door lock warmer is to be found in U.S. Pat. No. 2,530,513, which issued to A. Drugan on Nov. 21, 1950. This patent discloses a device for electrically heating the door key of a motor vehicle by electrical resistance elements. The device is attached to the exterior surface of an automobile. U.S. Pat. No. 3,192,359, which issued to W. Swindall on June 29, 1965, discloses an electrical heater for automobile door lock cylinders. The device is mounted within the door frame of an automobile and may be manually or automatically actuated in response to a freezing temperature. U.S. Pat. No. 3,662,149, which issued to R. Lipinski on May 9, 1972, discloses a thermistor automobile door lock heater. The thermistor has an electrical resistance which rises abruptly at a temperature near thirty two degrees Fahrenheit. Thus, at temperatures below thirty two degrees Fahrenheit the thermistor resistance will decrease causing an activation of the door lock heater. U.S. Pat. No. 4,303,825, which issued to N. Jaronen on Dec. 1, 1981, discloses a portable electric heating device for thawing motor vehicle door locks. An electrically heated probe is insertable into the keyhole of a frozen lock. U.S. Pat. No. 4,442,341, which issued to Y. Lesquereux et al on Apr. 10, 1984, discloses an electric heating device for vehicle lock cylinders which utilizes a thermistor heating element embedded in a heat conductive electrically insulative silicone-based compound. A U-shaped sheet metal strip electrically connected to one contact of the heating element is arranged to contact the lock cylinder.

While the above mentioned devices are suited for their intended usage, none of these devices utilizes an electric fan for circulating warmed air around an automobile door lock cylinder. Also, none of the above devices provides for both heating of the door lock cylinder and of the operator's hands and the door key. Further, none of the aforesaid devices utilizes a helical rib for swirling warmed air around an automobile door lock cylinder. Inasmuch as the art is relatively crowded with respect to these various types of automobile door lock warmers, it can be appreciated that there is a continuing need for and interest in improvements to such automobile door lock warmers, and in this respect, the present invention addresses this need and interest.

SUMMARY OF THE INVENTION

In view of the foregoing disadvantages inherent in the known types of automobile door lock warmers now present in the prior art, the present invention provides an improved automobile door lock warmer. As such, the general purpose of the present invention, which will be described subsequently in greater detail, is to provide a new and improved automobile door lock warmer which has all the advantages of the prior art automobile door lock warmers and none of the disadvantages.

To attain this, representative embodiments of the concepts of the present invention are illustrated in the drawings and make use of a housing which surrounds the door lock cylinder and in which an electrical resistance heating element and an electric fan are mounted. In one embodiment, the casing is provided with a helically extending rib for swirling heated air around the door lock cylinder. Exhaust ports direct the air out around the keyhole of the door lock cylinder, to warm the operator's hands and may also be utilized to warm the door key. A pivotal cover may be utilized which can be closed to cover the keyhole and the exhaust ports.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automobile door lock warmer which has all the advantages of the prior art automobile door lock warmers and none of the disadvantages.

It is another object of the present invention to provide a new and improved automobile door lock warmer which may be easily and efficiently manufactured and marketed.

It is a further object of the present invention to provide a new and improved automobile door lock warmer which is of a durable and reliable construction.

An even further object of the present invention is to provide a new and improved automobile door lock warmer which is susceptible of a low cost of manufacture with regard to both materials and labor, and which accordingly is then susceptible of low prices of sale to the consuming public, thereby making such automobile door lock warmers economically available to the buying public.

Still yet another object of the present invention is to provide a new and improved automobile door lock warmer which provides in the apparatuses and methods of the prior art some of the advantages thereof, while simultaneously overcoming some of the disadvantages normally associated therewith.

Still another object of the present invention is to provide a new and improved automobile door lock warmer which utilizes an electrical resistance heating element in conjunction with an electric fan to blow warmed air on an automobile door lock cylinder.

Yet another object of the present invention is to provide a new and improved automobile door lock warmer wherein an electrical resistance heating element in conjunction with an electric fan is utilized in a casing provided with an internally formed helical rib which directs air around an automobile door lock cylinder.

Even still another object of the present invention is to provide a new and improved automobile door lock warmer in which provisions are made for heating both the door lock cylinder and the door key as well as the operator's hands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
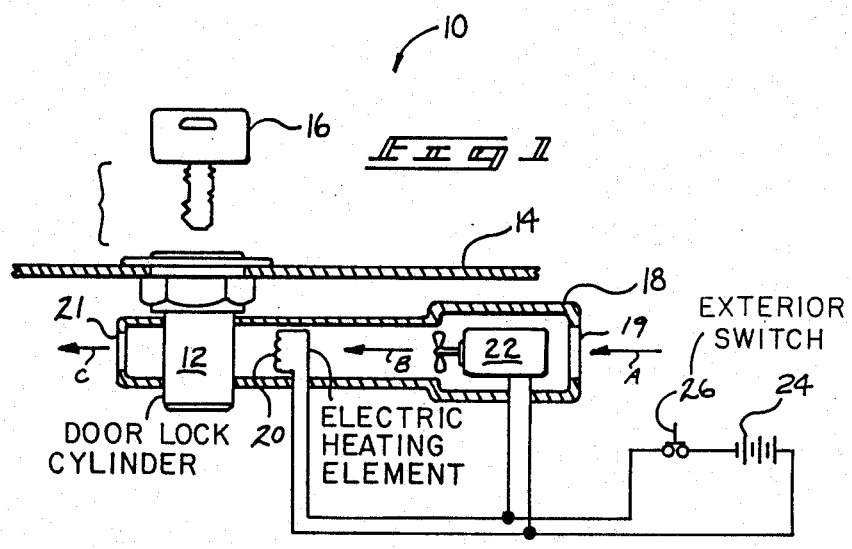
FIG. 1 is a view partially in cross section illustrating the automobile door lock cylinder warmer of the present invention installed within an automobile door.

With reference now to the drawings, and in particular to FIG. 1 thereof, a new and improved automobile door lock warmer embodying the principles and concepts of the present invention and generally designated by the reference numeral 10 will be described.

More specifically, it will be noted that the first embodiment 10 of the invention includes a housing 18 which surrounds a conventional automobile door lock cylinder 12. The door lock cylinder 12 is mounted through the exterior panel of an automobile door 14. A conventional key 16 is utilized in conjunction with the door lock cylinder 12. An electrical resistance heating element 20 is positioned adjacent the door lock cylinder 12. An electrical fan 22 operates to blow warmed air in an air inlet 19 of the casing adjacent the rear portion of the fan and around the door lock cylinder 12, exhausting the air outlet 21 at an opposite end of the casing 18 adjacent the door lock cylinder 12, as indicated by arrows A, B, and C. The motor vehicle battery 24 is utilized as a source of power for both the electrical resistance heating element 20 and the electric fan 22. Both of these devices are actuated by a switch 26 which is mounted so as to be accessible from the exterior of the automobile. The switch 26 may be mounted adjacent the door handle of the automobile.

Figure 2:
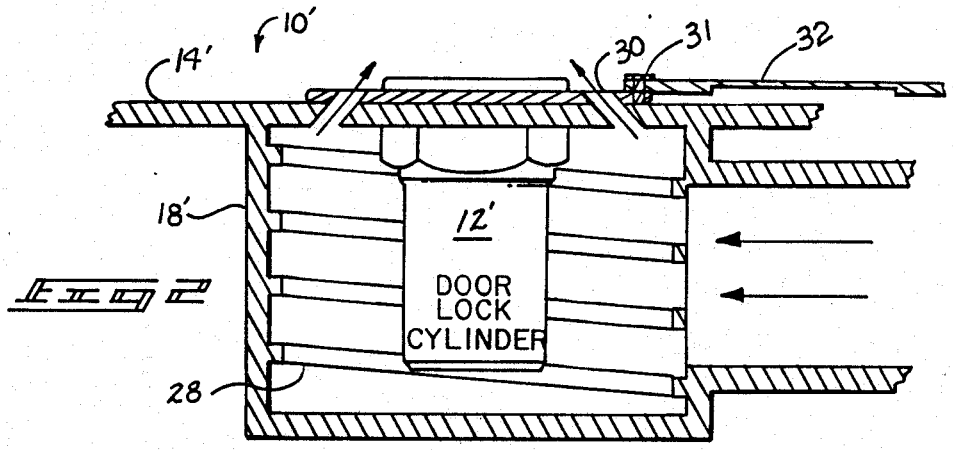
FIG. 2 is a partial cross section of an automobile door lock warmer according to a second embodiment of the present invention.

With reference now to FIG. 2, a second embodiment of the automobile door lock warmer of the present invention will be described. The second embodiment of the invention includes a conventional door lock cylinder 12' extending through the automobile door 14'. A casing 18' surrounds the door lock cylinder 12' and is in communication with a passage which supplies warmed air via fan 22 and electrical resistance heating element 20. A helical rib 28 extends around the interior of the casing 18'. This helical rib 28 serves to direct a flow of warmed air in a swirling pattern around the door lock cylinder 12' and through slanted exhaust ports 30. The swirling of the air stream created by the helical rib 28 serves to create turbulent air flow, thus increasing the heat transfer coefficient between the air stream and the door lock cylinder 12'.

Figure 3:
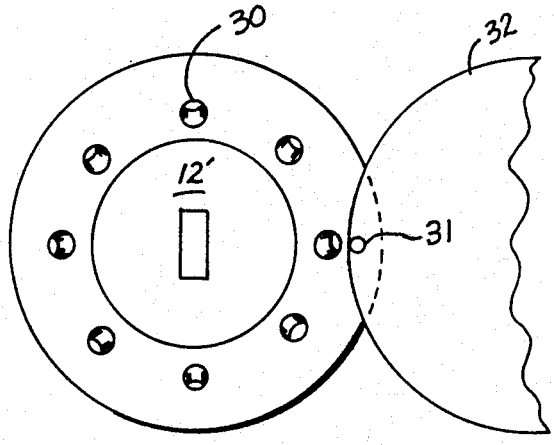
FIG. 3 is a front view of the door lock cylinder warmer of FIG. 2.

With reference now to FIG. 3, it can be seen that the exhaust ports 30 are spaced around the circumference of the lock cylinder 12'. These exhaust ports 30 are slanted inwardly so as to direct warmed air into a generally conical pattern. This supply of warmed air around the door lock cylinder 12' may be utilized to heat the door key by holding the door key in the conical air pattern. Also, this warmed air may be utilized to warm the operator's hands. A pivotal cover 32, mounted by a pivot pin 31, may be closed over the door lock cylinder 12' and surrounding air exhaust ports 30 to prevent moisture from entering both the keyhole and the exhaust ports.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United State is as follows:

1. In a combination with an automobile door provided with an interiorly located door lock cylinder, a new and improved automobile door lock warmer, comprising:

hollow casing means mounted in the interior of said automobile door;

said hollow casing means surrounding at least a portion of the automobile door lock cylinder;

electrical fan means in said casing means for blowing a stream of air on said portion of said door lock cylinder surrounded by said casing means;

electrical heating means in said casing means for heating said stream of air prior to impingement on said portion of said lock cylinder;

power means for supplying electrical energy to said heating means and said fan means; and switch means for selectively activating said electrical heating means and said electrical fan means.

2. The combination of claim 1, wherein said casing means has an air inlet formed adjacent a rear end portion of said electrical fan means and an air exhaust port formed adjacent said automobile door lock cylinder.

3. The combination of claim 1, wherein said hollow casing means has a first portion extending parallel to an outer surface of the automobile door and has a second communicating portion extending perpendicularly to said automobile door surface and parallel to and surrounding said automobile door lock cylinder.

4. The combination of claim 3, wherein said hollow casing means has an air inlet port adjacent a rear end portion of said electrical fan means and has exhaust port means on said second communicating portion extending through the automobile door.

5. The combination of claim 4, wherein said the second communicating portion of said hollow casing means has a helical rib which surrounds the door lock cylinder.

6. The combination of claim 4, wherein said exhaust port means includes a plurality of exhaust ports arranged around the periphery of the automobile door lock, said exhaust ports arranged to direct warmed air in a conical pattern.

7. The combination of claim 6, wherein a pivotal cover, provided on an outer surface of the door lock cylinder, is movable from an open to a closed position and which covers the door lock cylinder and said exhaust ports when in a closed position.

* * * * *